United States Patent [19]

Hamill et al.

[11] 4,449,387

[45] May 22, 1984

[54] TUBE BENDING MACHINE

[75] Inventors: Anthony C. Hamill, Glasgow, Scotland; Ronald J. Hawkins, Morden, England

[73] Assignee: Babcock Power Limited, London, England

[21] Appl. No.: 330,807

[22] Filed: Dec. 15, 1981

[30] Foreign Application Priority Data

Dec. 17, 1980 [GB] United Kingdom ..... 8040450
Apr. 1, 1981 [GB] United Kingdom ..... 8110280

[51] Int. Cl.[3] ..... B21D 7/04; B21D 11/06

[52] U.S. Cl. ..... 72/215; 72/369; 72/388

[58] Field of Search ..... 72/135, 215, 216, 217, 72/218, 245, 387, 388, 318, 319, 369, 157

[56] References Cited

U.S. PATENT DOCUMENTS 2,413,523 12/1946 Shaw, Jr. ..... 72/319
2,747,645 5/1956 Nichols et al. ..... 72/245

*Primary Examiner*—Francis S. Husar
*Assistant Examiner*—Steven B. Katz
*Attorney, Agent, or Firm*—Kemon & Estabrook

[57] ABSTRACT

A tube bending machine with rotary arms carrying a bending moment roller and a bending fulcrum roller has arm shafts mounted for axial movement. The arms are rotated for the tube bending action, whereby the bend so made in the tube lies in a predetermined non-planar arc. The arm shafts are turned by a pinion engaged by a rack and are moved axially by suitable pins engaged in cam slots with the rack and the cam slots all being moved simultaneously. In order to retain the tube in proper location or position during the trusts of non-planar arc bending there may be included more than one roller.

11 Claims, 15 Drawing Figures

TUBE BENDING MACHINE

DESCRIPTION

This invention relates to tube bending machines.

A known kind of tube bending machine is operative to bend a tube into an arc by the rotation on a common axis of two arms holding respective grooved rollers engaging the tube of which one roller serves to apply a bending moment to the tube about the other roller which serves as a bending fulcrum for the tube.

In the use of such a machine as hitherto constructed, the machine is appropriately positioned in relation to the two tube alignments between which the bend is to extend and the machine is operated to bend the tube into a planar arc form between the two alignments.

If the two tube alignments between which the tube bend is to extend do not intersect one another, it is impossible to design the tube bend so that it shall have a simple planar arc form. In general, it would be advantageous to be able with a single positioning of a tube bending machine to bend a tube into a predetermined arc extending otherwise than wholly as a planar arc in a plane perpendicular to the axis of rotation of the arms.

In a tube bending machine operative to bend a tube into an arc by the rotation on a common axis of two arms holding respective roller means engaging the tube of which one roller means serves to apply a bending moment to the tube about the other roller means which serves as a bending fulcrum for the tube, according to the present invention mountings of shafts respectively carrying the arms in the machine body allow axial movements of the said shafts and means are provided to impose, as the arms are rotated, respective axial movements of the said shafts that are adapted to effect bending of a tube into a predetermined arc extending otherwise than wholly as a planar arc in a plane at right angles to the axis of rotation of the arms.

Preferably, each roller means is held by its arm in such a way that the roller means can adjust its line of action during the bending procedure to agree with the axial direction of the part of the tube which it engages. Thus each roller means may be rotatably mounted in a swivel frame which can pivot in relation to the arm on an axis which intersects at right angles the axis of the part of the tube engaged by the roller means.

It may sometimes be preferable if the roller means or each roller means instead of being a single grooved roller is a group or set of rollers arranged for applying the necessary forces to the tube without developing forces tending to displacement of the tube from a due position in relation to the arm or while preventing such displacement.

Figure 1:
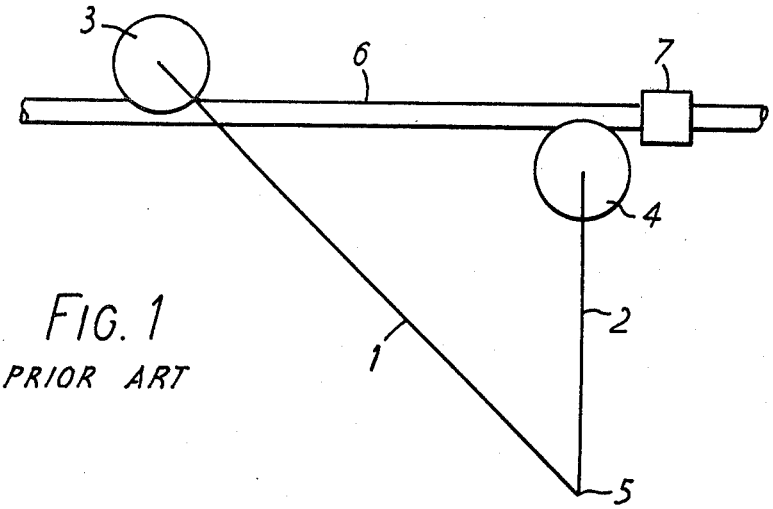
FIG. 1 PRIOR ART
Figure 2:
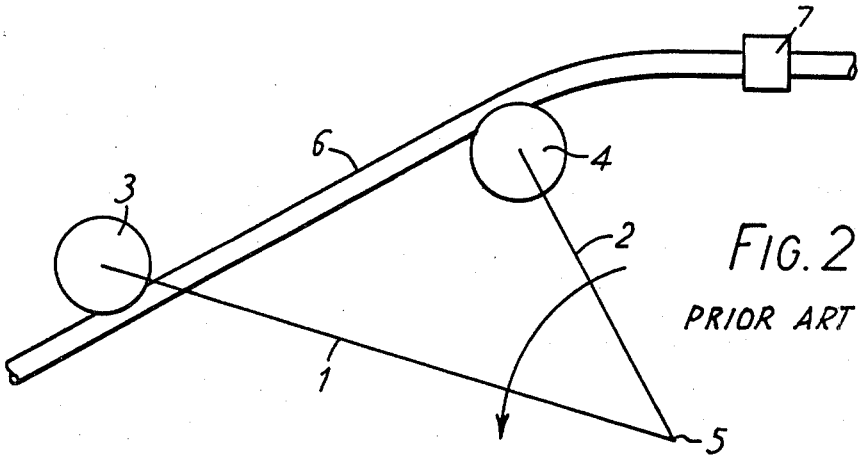
FIG. 2 PRIOR ART
Figure 3:
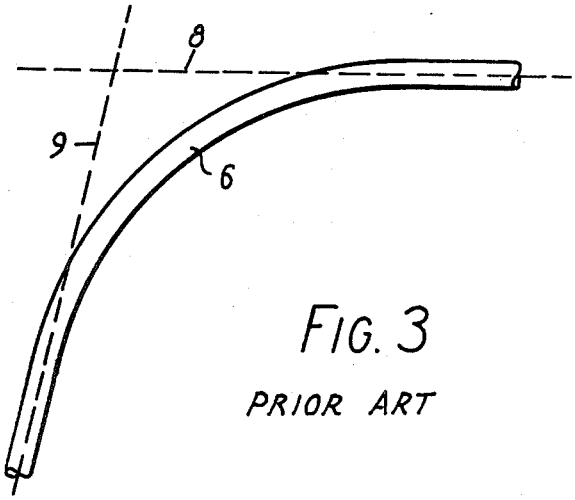
FIG. 3 PRIOR ART
Figure 4:
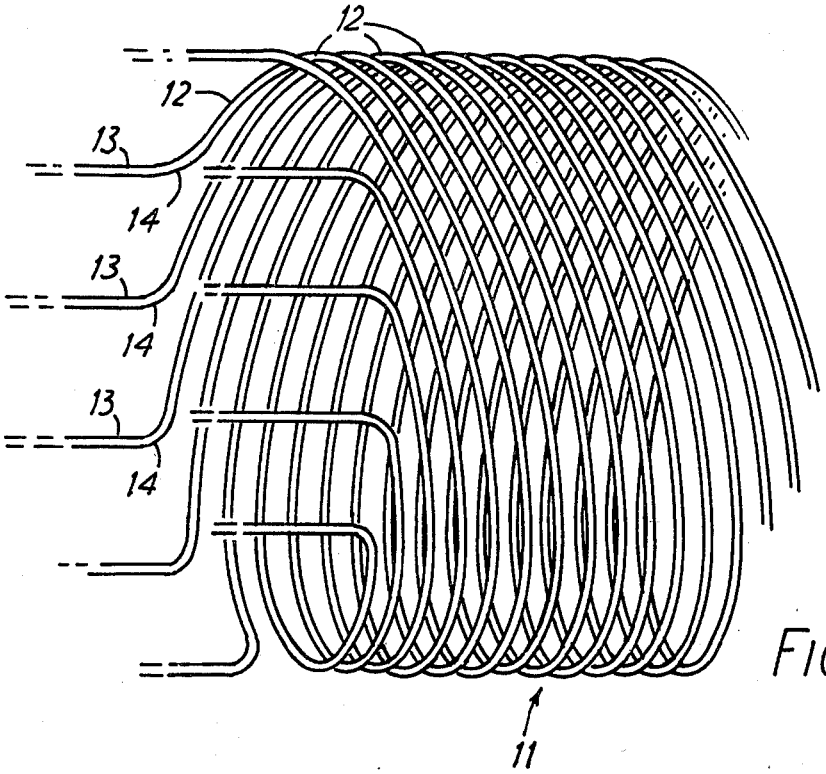

The invention will now be described by way of example with reference to the accompanying drawings, in which FIGS. 1 and 2 schematically illustrate the operation of a known kind of tube bending machine, FIG. 3 is a diagram referred to in the description of the said operation, FIG. 4 is a diagram in perspective of one end of a cylindrical tubesheet component of a helically coiled tube bundle for a heat exchanger.

Figure 5:
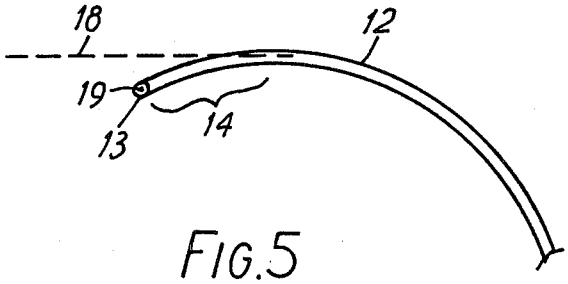

FIG. 5 represents one of the tube tail ends with its tail bend included in FIG. 4, but viewed parallel to the tubesheet axis from the left end of FIG. 4.

Figure 9:
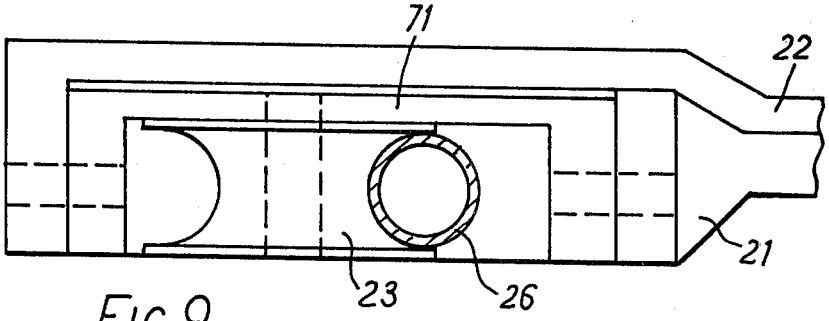
Figure 6:
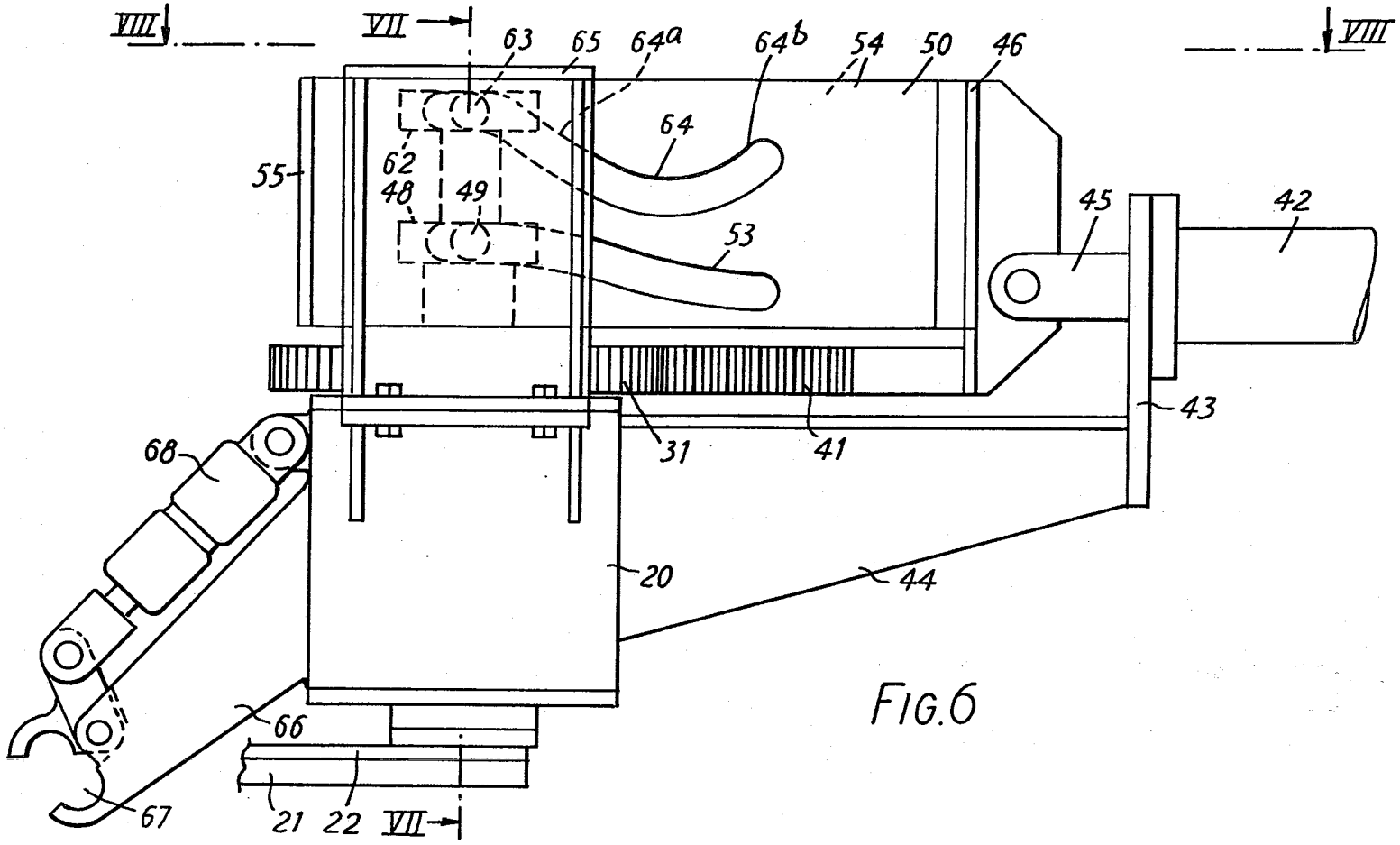
Figure 7:
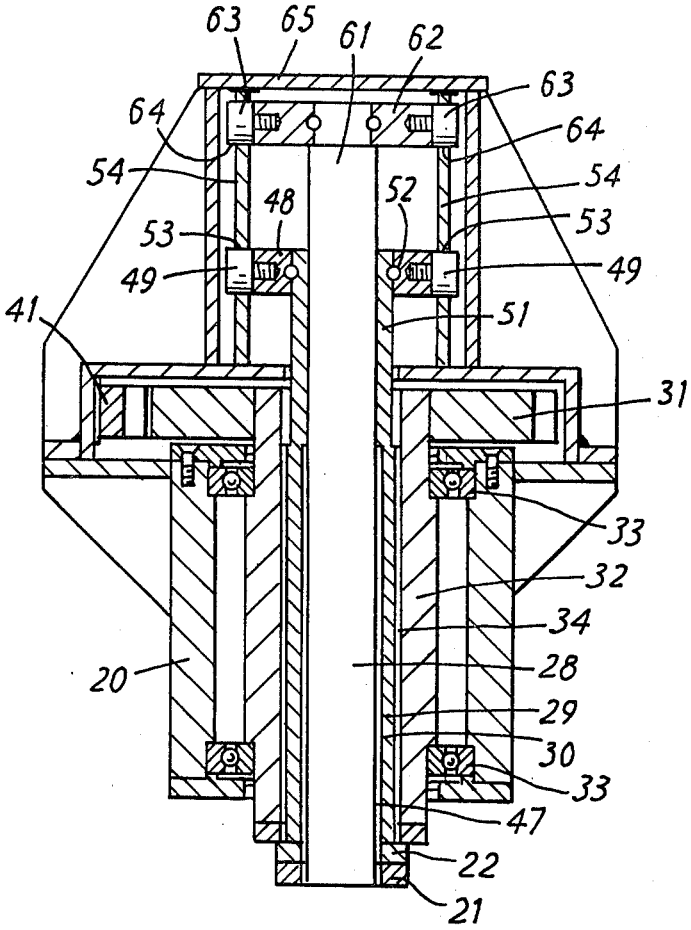
Figure 8:
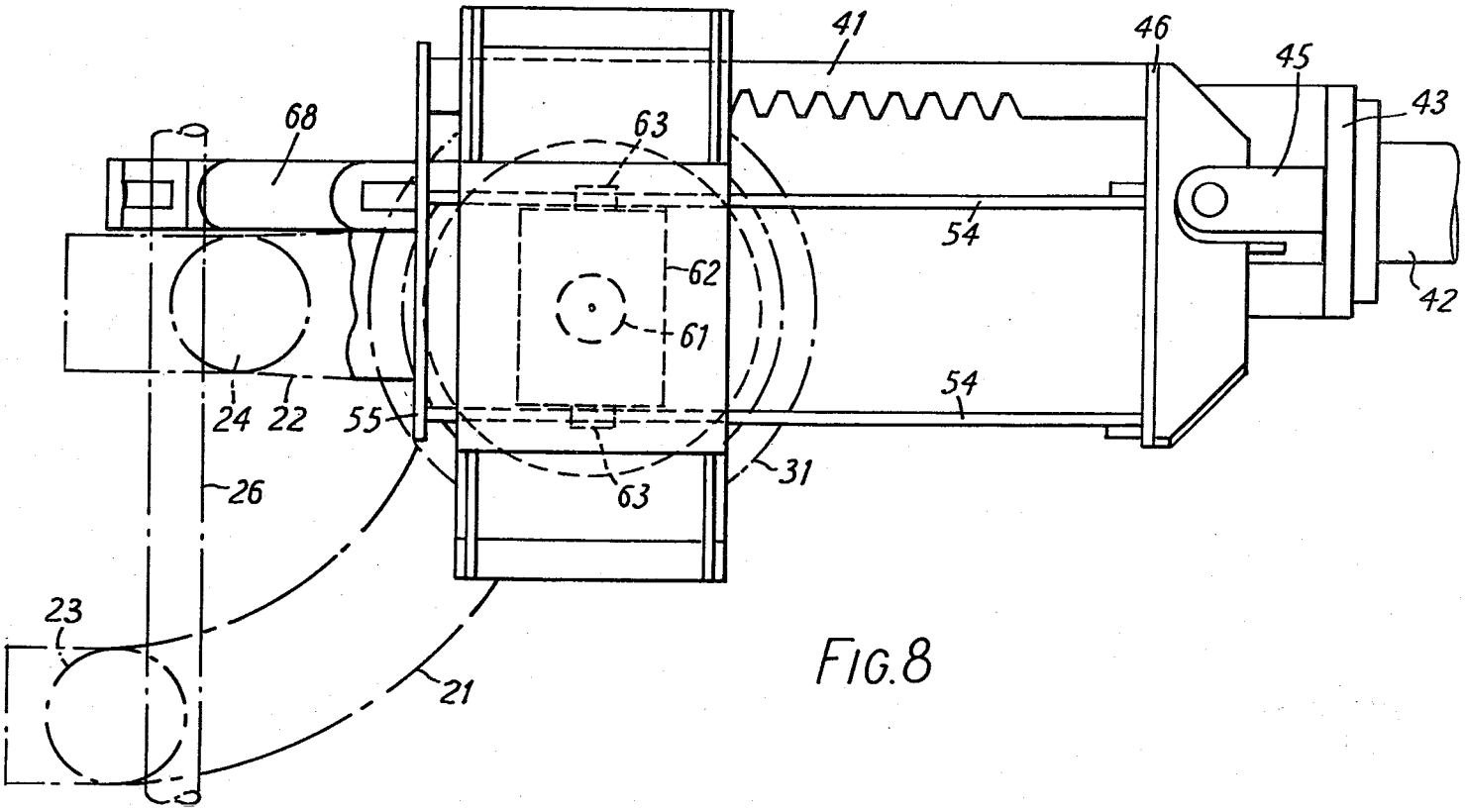
Figure 10:
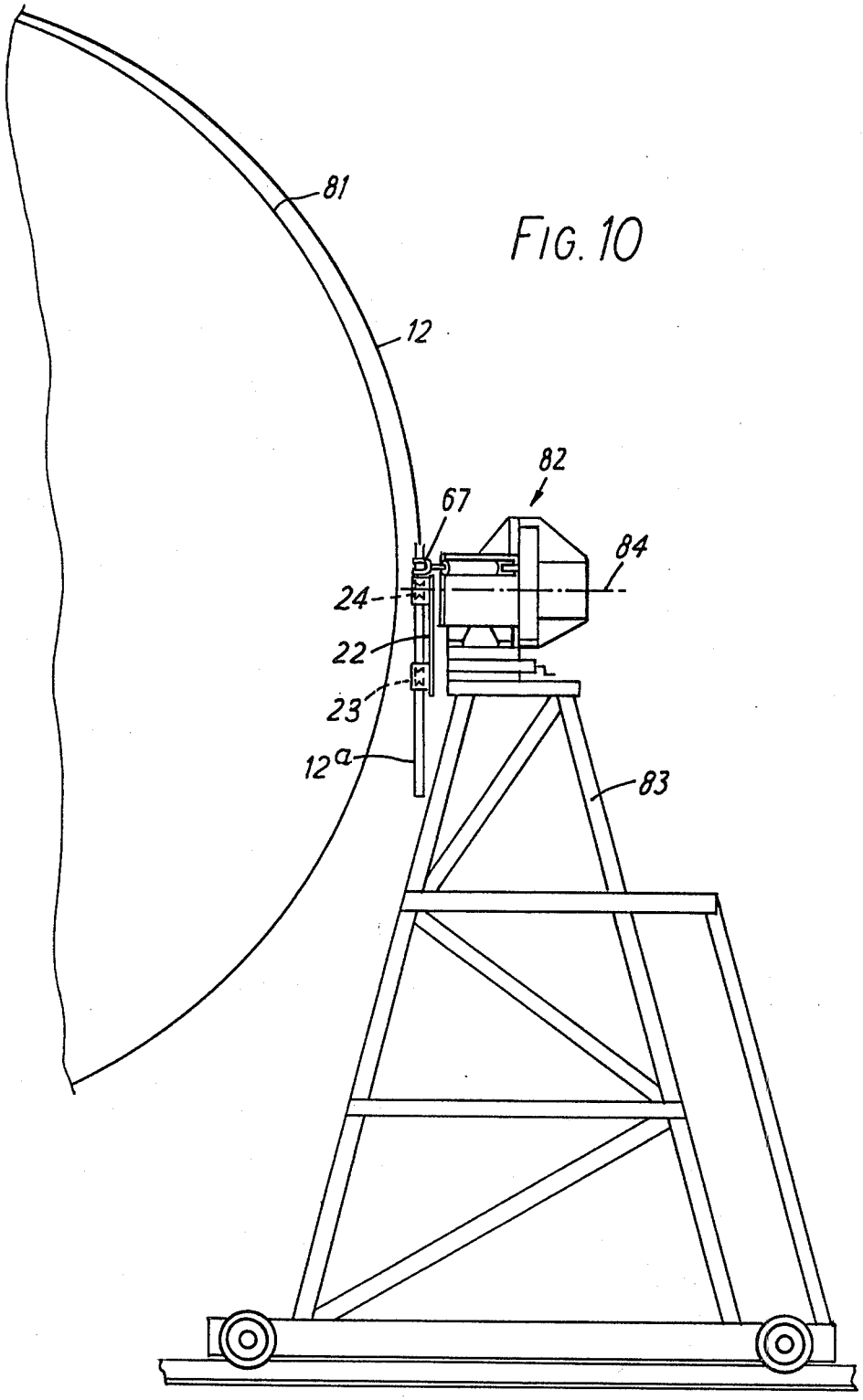
Figure 11:
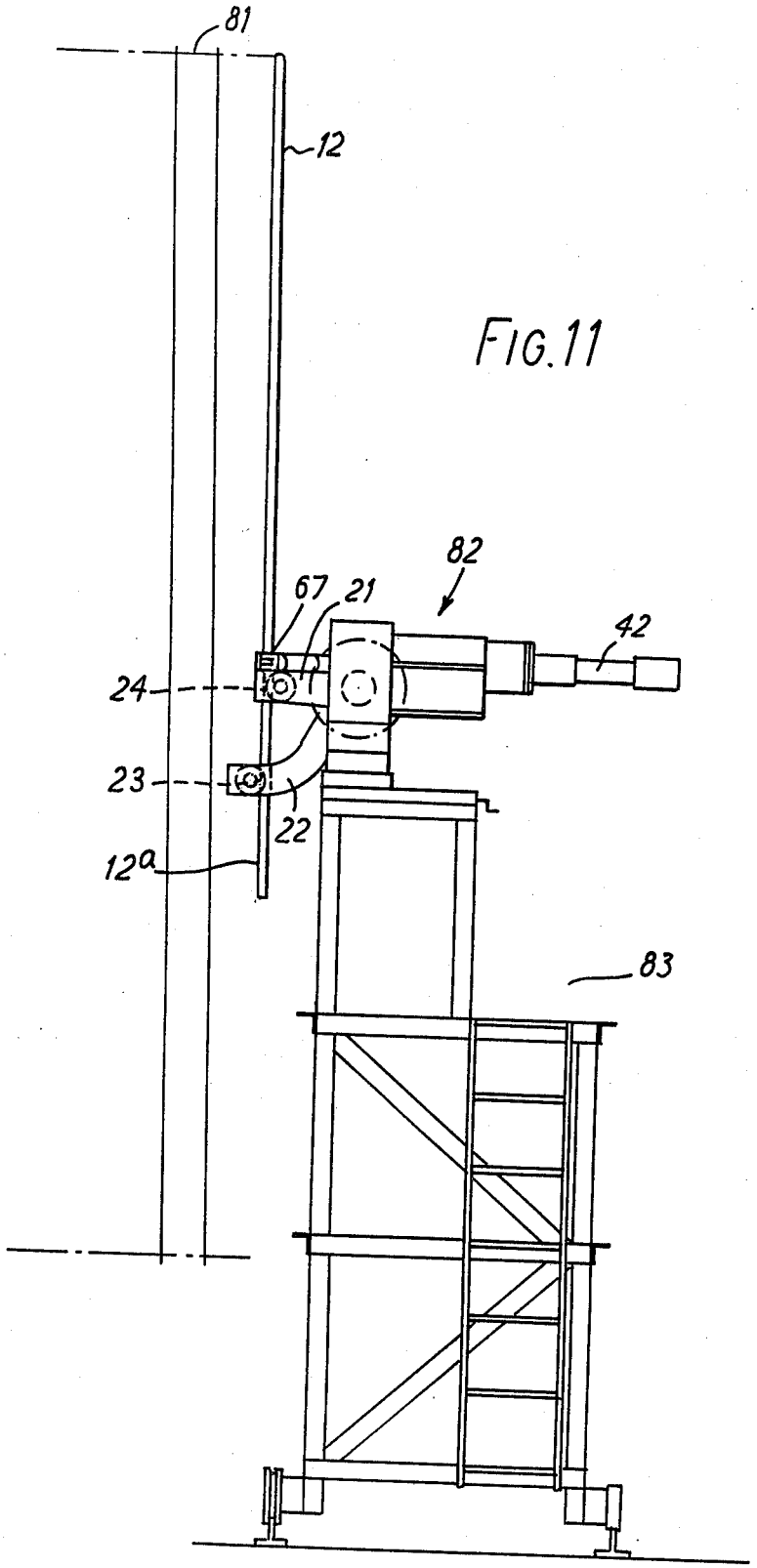

FIG. 6 is a view of a tube bending machine adapted to form tube tail bends of the kind referred to in connection with FIGS. 4 and 5, FIG. 7 is a view of the machine in section on the line VII—VII of FIG. 6, FIG. 8 is a view of the machine as seen from the line VIII—VIII of FIG. 6, FIG. 9 shows the mounting in a swivel frame of a grooved roller of the machine, FIG. 10 is an elevation, and FIG. 11 a plan, of a tube bending machine supported in proximity to a tube sheet for the formation of tube tail bends therein, and FIGS. 12 to 15 schematically show arrangements using pairs of rollers on tube being machine arms instead of single grooved rollers.

With reference to FIGS. 1 and 2 of the drawings, a known kind of tube bending machine essentially comprises a body (not shown) providing supporting bearings for the shafts (not shown) of two arms 1 and 2 holding respective grooved rollers 3 and 4 and rotatable on a common axis 5, one of the rollers, as shown the roller 3, serves to apply to a tube 6 to be operated on a bending moment about the other roller 4 which serves as a bending fulcrum for the tube, to achieve which end the arm 1 holding the roller 3 is longer than the arm 2 and the roller 3 engages the side of the tube 6 that faces away from the axis 5 while the roller 4 on the arm 2 engages the side of the tube that faces towards the axis 5. The reactions on the bending machine body when the arms 1 and 2 are rotated relatively thereto about the axis 5 and the reactions on the length of the tube not to enter into the bending movements demand that no relative movement shall be permitted between the bending machine body and clamping means 7 for the tube; to this end the clamping means 7 may be provided by or be rigidly secured to the bending machine body, preferably the bending machine body is secured to a rigid support.

In the use of such a machine as hitherto constructed the machine is positioned in relation to two intersecting tube alignments between which the bend to be made is to extend, say alignment 8 and alignment 9 shown in FIG. 3, in such a way that the rollers 3 and 4, commencing from a position such as that of FIG. 1, move in the plane of the intersecting alignments when the arms 1 and 2 are rotated, through a position such as that of FIG. 2, finally to complete the formation of a planar arc bend between the two alignments.

The utility of a tube bending machine which might be able to bend a tube into a desired non-planar arc has recently become more particularly apparent to the inventors when planning the fabrication of a helically coiled tube bundle for a liquid sodium/water and/or steam heat exchanger.

The helically coiled tube bundle is designed to fit within an annular passage for liquid sodium and consists of a multiplicity of parallel-connected tubes each of which is helically coiled around the annular passage. The helical coils of each tube have a constant helical radius and a constant helical pitch along the length of the tube bundle. There are a number of helical radii and to each helical radius pertains a plurality of tubes which will be termed a cylindrical tubesheet. Thus the helical tube bundle comprises a plurality of co-axial cylindrical tube sheets. The tubes are held in relative position by spacing means.

At one end of the tube bundle the coiled parts of the tubes suitably connect with respective axially extending tube lengths or tube tails for the supplying of the tubes with water and/or steam and at the other end of the tube bundle the coiled parts of the tubes suitably connect with respective axially extending tube lengths or tube tails for the withdrawal of the water and/or steam from the tubes. Analysis shows that at each end of the tube bundle unless the connecting band, which will be termed a tail bend, between the coiled part of each tube of a cylindrical tubesheet and its appropriate axially extending tube tail can be made to lie on or fairly closely on the cylindrical surface extension of the cylindrical tubesheet one or more of several different drawbacks may be experienced. At the same time the number of tubes may be so great as to make it highly desirable to form each tail bend by a single bending operation only.

With reference to FIG. 4, which shows how one end of a cylindrical tube sheet 11, if seen separately from all the other cylindrical tube sheets, co-axial therewith, of the helically coiled tube bundle, might appear, the helically coiled tubes 12 constituting the cylindrical tube sheet 11 connect at the end of the tube sheet with respective axially extending tube lengths or tube tails 13 through respective connecting or tail bends 14.

From what has been said, it is desirable that each tail bend 14 between the coiled part of a tube 12 and the appropriate tube tail 13 shall lie on or fairly closely on the extension of the cylinder surface in which the tube coils lie. With reference to FIG. 5, since at one end of each bend 14 the tube alignment 18 is tangential to the cylinder and at the other end of the bend 14 the tube tail alignment 19, perpendicular to the paper, is parallel to the cylinder axis and on or close to the cylinder surface extension, the two alignments 18 and 9 do not intersect and the shape of the bend 14 to meet the desiderata is non-planar.

With reference to FIGS. 6 to 9, a tube bending machine designed for the forming of non-planar tube tail bends comprises a body 20 through which extend respective operating shafts 28 and 29 of arms 21 and 22 holding bending moment and bending fulcrum grooved rollers 23 and 24 and which carries means to be described for rotating the said shafts and for giving the shafts axial movements as they are rotated.

The bending fulcrum arm 22 which holds the bending fulcrum grooved roller 24 is attached to an end of the operating shaft 29 therefor, which shaft projects from the bending machine body 20 and is axially slidable in the said body. The operating shaft 29 is formed with a passage 30 extending from end to end of the shaft co-axially therewith, the bending moment arm 21 which holds the bending moment grooved roller 23 is attached to an end, projecting from the said passage 30, of the operating shaft 28, which extends along the said passage 30 co-axially with the operating shaft 29 and is axially slidable within the said passage 30.

Mounted for rotation at a fixed position on the bending machine body 20, at the end thereof remote from the arms 21 and 22, is a driving pinion 31 which is keyed to one end of a driving sleeve 32 which extends within the bending machine body 20 and therein embraces the outer operating shaft 29, the driving sleeve 32 is rotatable in relation to the bending machine body 20 by virtue of rotary bearings 33 at the two ends of the body, which bearings otherwise locate the sleeve 32 within the body; the inner surface of the driving sleeve 32 and the outer face of the shaft 29 are in engagement with one another by splines 34, enabling rotation of the pinion 31 to effect rotation together of the sleeve 32 and the shaft 29 allowing axial movement of the said shaft in relation to the pinion and to the bending machine body.

The driving pinion 31 is engaged by a rack 41 which is mounted for movement along a path fixed in relation to the bending machine body and for the operation of which a double-acting hydraulic piston-and-cylinder arrangement 42 is provided. The cylinders of the arrangement 42 are mounted on the outer surface of a plate 43 at the distal end of a wing arm 44 extending laterally from the body 20, while the piston rod of the arrangement 42 extends through said plate 43 to a clevis 45 bolted to a lug on a thrust plate 46 to which the distal end of the rack 41 is attached.

The inner face of the passage 30 in the outer shaft 29 and the outer face of the inner shaft 28 are in engagement with one another by splines 47, enabling rotation of the outer shaft 29 to effect simultaneous rotation of the inner shaft 28 while allowing axial movement of the inner shaft 28 in relation to the outer shaft 29 and to the bending machine body 20.

For an imposition on the outer shaft 29, as it is rotated by operation of the rack 41 and pinion 31, of an axial movement in relation to the bending machine body 20, there are provided an axial-drive collar 48 mounted on the said shaft, a pair of roller pins 49 on the collar and cam means 50 arranged to be moved with the rack 41 by the mentioned hydraulic arrangement 42 and along a path parallel with the rack. The end 51 of the shaft 29 remote from the bending fulcrum arm 22 projects from the bending machine body and at its extremity the axial-drive collar 48 extends around it and engages it through a rotary bearing 52 through which axial thrusts may be transmitted to the shaft 22. At opposite sides of the collar 48 the roller pins 49, one diametrically opposite to the other in relation to the shaft 29, project into respective cam slots 53 in respective replaceable parallel cam plates 54 of the cam means 50. The collar 48 is rectangular, the opposite plane sides whereof from which project the roller pins 49 serve to preserve the orientation of the collar in relation to the cam plates as the latter are moved with the rack by the hydraulic arrangement, so that the roller pins always project into the cam slots.

The end 61 of the inner shaft 28 remote from the bending moment arm 21 projects beyond the corresponding end 51 of the outer shaft 29 and, for an imposition on the inner shaft 28, as it is rotated by means of the outer shaft 29 when the rack and pinion are operated, of an axial movement in relation to the bending machine body there are provided an axial-drive collar 62, mounted on the inner shaft 28 at its extremity in the same way as the first-mentioned axial drive collar 48 is mounted on the outer shaft 29, and a pair of roller pins 63 on the collar 62, one roller pin diametrically opposite to the other in relation to the shaft 28, which project into respective cam slots 64, different from the first-mentioned cam slots 53, in the cam plates 54 of the cam means 50. The axial-drive collar 62 is rectangular, for the same reason as is the axial-drive collar 48.

Each cam plate 54 is attached at one end to the thrust plate 46 moved by the hydraulic arrangement and at the other end to a common plate 55, to which is also attached the end of the rack 41 remote from the thrust plate 46. Mounted on the machine body is a gate frame 65 for guiding the cam plates 54 in the vicinity of the shaft ends 51 and 61 and supporting them against thrusts on them parallel to the axis of the shafts due to reactions exerted by the roller pins 49 and 63.

The bending machine body, in order that it may be maintained stationary during a bending procedure in relation to the tubework that is not to be involved in the bending procedure, includes an arm 66 with a clamp 67, tightenable by a hydraulic piston-and-cylinder arrangement 68, for attachment to the tube at a location not involved in the bending and adjacent the point at which the bend is to commence.

With the apparatus described with reference to FIGS. 6 to 8 when the hydraulic piston and cylinder arrangement 42 is operated to move the thrust plate 46 the rack 41 and the two cam plates 54, all attached to the thrust plate, are simultaneously moved, the pinion 31, engaged by the rack 41, is turned and therewith the driving sleeve 32 and the outer and inner shafts 29 and 28 are simultaneously rotated, as the shafts are rotated the outer shaft 29 moves axially in accordance with the dictates of the cam slots 53 in the cam plates 54 and the inner shaft 28 moves axially in accordance with the dictates of the cam slots 64 in the cam plates. With the outer shaft 29 there move the bending fulcrum arm 22 and the bending fulcrum roller 24 held thereby and with the inner shaft 28 there move the bending moment arm 21 and the bending moment roller 23 held thereby, the movement of the two grooved rollers 23 and 24 determines the shape of the arc into which a tube operated on will be bent. For the determination of the cam slot profiles that will make possible tube bending into a desired non-planar arc calculations may need to be supplemented by experiment since the non-planar character of the bending entails complex stress patterns in the tube during the operation.

The cam slots 53 and 64 are shown in FIG. 6 with profiles of a joint character which it is believed will be appropriate for the formation of tube bends such as the tube bends 14 discussed with reference to FIGS. 4 and 5, the machine, positioned as will be described with reference to FIGS. 10 and 11, being used to bend each tube 12 from the alignment 18 through the bend 14 into the alignment 19. Initially both rollers 23 and 24 are positioned along the alignment 18. As the bending is commenced, then since the roller 23 is further from the starting point of the intended bend 14 than the roller 24 the shaft 28 of the roller 23 should be moved, as the bending is commenced, faster along its axis than the shaft 29 of the roller 24 is moved and the cam slots 64 accordingly have a steeper inclination at **64*a* to the movement direction of the cam plates 50 than have the can slots 53. In order that at the end of the bend formation the shafts 28 and 29 shall have the same axial position, as is appropriate for the final tube alignment 19, towards the end of the bend formation the shaft 28 must be reversed in movement along its axis, and the cam slots 64 accordingly have an inclination at 64*b* to the movement direction of the cam plates 50 that is the opposite of their initial inclination at 64*a***.

The arm 21 holds the bending moment grooved roller 23 and the arm 22 holds the bending fulcrum grooved roller 24 through respective swivel frames in which the rollers are rotatably mounted and which can so pivot in relation to the arms that each roller can adjust its plane during the bending procedure to agree with the axial direction of the part of the tube which the roller engages. Thus, with reference to FIG. 9, at the end of the arm 21 the bending moment grooved roller 23 is rotatably mounted in a swivel frame 71 carried by the arm which, within limits, can pivot to allow the roller groove to align itself with the local direction of the tube, the swivel frame is so carried that its pivot axis is at right angles to the local direction of the tube and intersects the tube centre line.

With reference to FIGS. 10 and 11, for the making of tail bends at an end of a cylindrical tubesheet 81 for a helically coiled tube bundle, the tubesheet of helically coiled tubes is mounted on a support (not shown) with its axis horizontal and a tube bending machine 82 of the kind described with reference to FIGS. 6 to 9 is mounted on a separate support 83 with the common axis 84 of the arm operating shafts horizontal. The cam slots of the tube tending machine are such that the bending moment roller 23 and the bending fulcrum roller 24 in their initial positions lie in a common plane at right angles to the said axis 84, which plane is therefore vertical, and the machine is positioned on the support 83 so that the said plane is parallel to the tubesheet axis and also so that the two rollers in their initial positions can engage the straight tail **12*a*, extending downwardly tangentially to the tube sheet cylindrical form, of a tube 12** strained outwardly of the remainder of the tube sheet sufficiently to enable the tail bend to be made without interfering with the tube tails, already bent or not yet bent, of the remainder of the tubesheet.

With the bending machine clamp 67 clasping the tube at the junction between the helically coiled portion and the straight tail portion **12*a* thereof the machine is operated to rotate the two arms 21 and 22, during the rotation of which the cam slots of the machine move in relation to the roller pins thereof and the arm operating shafts thereof are displaced axially while they are rotated. The cam slots are profiled so that the rollers 23 and 24, as the arms 21 and 22 rotate, effect a bend in the tube tail 12*a*** which extends from its initial direction into an alignment parallel to the tubesheet axis in such a way that when the tube is thereafter released not only does the said alignment lie in the cylindrical surface extension of the tube sheet, or closely so, but so also do all intermediate points of the arc of the bend, or closely so.

When the bend has been made, the tube is released from the clamp 67 and from the bending machine, the arms 21 and 22 are brought back to their original positions, the tube sheet is rotated sufficiently around its axis and another tube of the tubesheet is operated upon in the same way.

If tail bends are to be made by the same bending machine in the tubes of another tubesheet of a different diameter, the cam plates of the machine may be replaced by cam plates with cam slots of a different profile in order that the tail bends when made may have the appropriate shapes. However, if a number of tube sheets have diameters which do not greatly differ, it may suffice to make all the tail bends by the machine without replacement of the cam plates thereof.

When the tube is bent in a non-planar arc it is not only the bottoms of the grooves of the rollers that exert bending stresses on the tube but also in general one or both of the flanges of one or both of the rollers. The forces applied to a tube by the roller flanges during the bending operation may not be sufficient to displace the tube from the roller groove bottoms but if there is a possibility that under some circumstances the tube will obey a tendency to ride up the inner surface of a roller flange away from the roller groove bottom we should prefer to provide on the appropriate arm, in place of a single grooved roller, a group or set of rollers arranged for applying the necessary forces to the tube without developing forces tending to a displacement of the tube from a due position in relation to the arm or while preventing such displacement.

The group or set of rollers may comprise a multiplicity of rollers, say five, arranged with all their planes intersecting in a common line and providing tube bearing surfaces which can together largely embrace the tube on three sides. However, practical considerations such as those of bulk may preclude the use of so many rollers on an arm of the machine.

Figure 12:
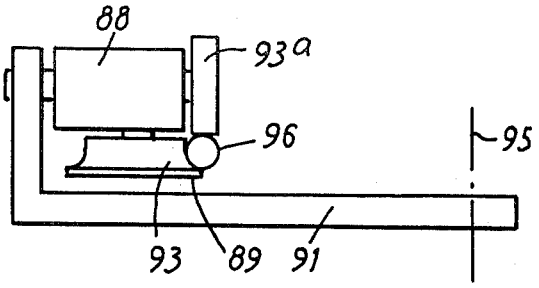

With reference to FIG. 12, a pair of rollers serving to apply the bending moments to a tube 96 for non-planar arc tube bending comprises a main roller 93 positioned for the application to the tube of the necessary bending moment force largely directed towards the arm rotary axis 95 of the machine together with an auxiliary roller 93*a* positioned with its plane at right angles to the plane of the main roller 93 and for the application to the tube of the necessary bending moment force directed largely parallel to the arm rotary axis. The main roller 93 is formed with a flange 88 capable of preventing the tube from moving away from the auxiliary roller 93*a*, such flange is part of a curved surface conforming to the tube radius, thus the main roller 93 resembles the form of one half of a grooved roller split at a median plane at right angles to the roller axis. The auxiliary roller 93*a* is formed with a plain, cylindrical surface but it may alternatively be formed with a shallowly grooved surface. The two rollers of the pair are rotatably mounted is a common swivel frame 88 which can pivot in relation to the bending moment arm 91 in such a way that the main roller 93 can adjust its plane during the bending procedure to accord with the local axial direction of the part of the tube engaged by the pair of rollers. The swivel axis should be at right angles to the local axial direction of the tube but it does not intersect the tube axis.

Figure 13:
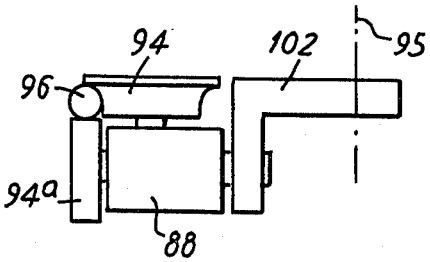

With reference to FIG. 13, a pair of rollers serving as the bending fulcrum for the tube comprises a main roller 94 and an auxiliary roller 94*a* similar to the respective rollers 93 and 93*a* of FIG. 12 and operating as described with reference to FIG. 12, with the difference that will be well understood that the main roller 94 must be positioned to apply to the tube a fulcrum reaction force directed largely away from the arm rotary axis 95 of the machine and the auxiliary roller 94*a* must be positioned to apply to the tube a fulcrum reaction force directed largely parallel to the arm rotary axis in the opposite sense to the action of the bending moment auxiliary roller.

Figure 14:
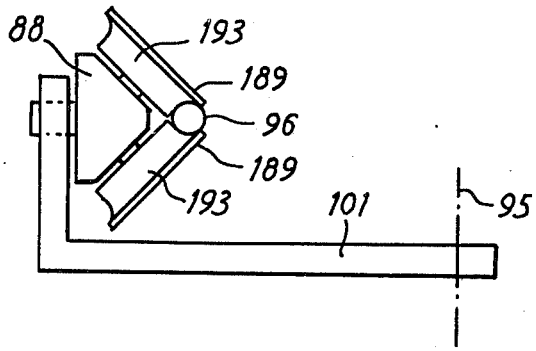

With reference to FIG. 14, a pair of rollers serving to apply the bending moments to a tube 96 for non-planar arc tube bending comprises a pair of similar rollers 193 which have their planes at an angle to one another and which bear simultaneously on the tube 96 to apply the necessary bending moment force directed largely towards the arm rotary axis 95 of the machine and either one of which can provide the necessary bending moment force directed largely parallel to the said arm rotary axis, and which have flanges 189 preventing displacement of the tube from its due position in relation to the bending moment arm 101 during the bending procedure. If as shown the planes of the rollers 193 intersect the arm rotary axis 95 at opposed angles of the same magnitude the roller pair is adapted to provide equally effectively a bending moment force directed largely parallel to the arm rotary axis whether such force requires to be in one direction or in the opposite direction. The flanges form parts of curved roller surfaces conforming to the radius of the tube. The two rollers are mounted in a common swivel frame 88 which can pivot in relation to the arm 101 in such a way that the line of intersection of the planes of the rollers may adjust itself during the bending procedure to accord with the local axial direction of the part of the tube engaged by the pair of rollers. The swivel axis should be at right angles to the tubes and it intersects the tube axis.

Figure 15:
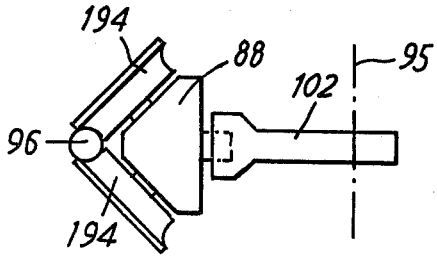

With reference to FIG. 15, in a tube bending machine with a pair of rollers 194 serving as the bending fulcrum for the tube for non-planar arc tube bending the two rollers are positioned and formed and operate as described with reference to the rollers 193 of FIG. 14, with the difference that will be well understood that their positioning must be such that they can bear simultaneously on the tube 96 to apply to the tube a fulcrum reaction force directed largely away from the arm rotary axis 95 of the machine.

We claim:

1. In a tube bending machine having a body with shaft means rotatably mounted therein and first and second arms carried by said shaft means with the first arm holding a roller means for engaging a tube and serving as a bending fulcrum for said tube and the second arm holding a roller means for engaging the tube to apply a bending moment to the tube about said bending fulcrum in the operation of said machine contemporaneous with operating means imposing an angular movement on said shaft means about its axis to effect an arcuate bending of the tube, the improvement comprising said shaft means including a first shaft with said first arm carried thereby and a second shaft with said second arm carried thereby, one of said shafts being rotatably mounted in said body and coaxially mounting the other of the said shaft, said mountings allowing independent axial movements of said arms, a first and second cam means carried by said body with said first cam means arranged to impose a predetermined axial movement on the first shaft simultaneously with the rotary movement thereof and said second cam means arranged to impose a predetermined axial movement on the second shaft simultaneously with the rotary movement thereof whereby operation of the machine effects a predetermined non-planar arcuate bending of the tube.

2. A machine as claimed in claim 1, wherein said first and second shafts have pins mounted therein engagable with respective slots provided in said first and second cam means.

3. A machine as claimed in claim 2, wherein said pins are mounted on the respective first and second shafts by means of collars with respect to which the first and second shafts may make angular movements but which are arranged to be non-rotary with respect to the machine body.

4. A machine as claimed in claim 2, wherein the slots are formed in two cam plates arranged on either side of the shafts.

5. A machine as claimed in claim 4, wherein the means for imposing an angular movement of the shafts includes a hydraulic piston-and-cylinder arrangement, the piston of which is connected simultaneously to move the two cam plates past the shafts transversely of the axis of the shafts.

6. A machine as claimed in claim 5, wherein the said operating means includes a rack connected to said piston, a pinion meshing with the rack and co-axial with the shafts, an internally splined tubular driving sleeve attached to the pinion and surrounding said first shaft, external splines on said first shaft engaging with the internal splines of the tubular driving sleeve, internal splines on the said first shaft and external splines on the said second shaft engaging with the internal splines on the said first shaft.

7. A machine as claimed in claim 1, including a swivel frame at the end of each of the said first and second arms, rotary mountings in the swivel frame for the roller means held by said arms, bearings in the arms for said swivel frame and aligned at right angles to the local direction of the tube being bent.

8. A machine as claimed in claim 7, wherein the alignment of the swivel frame bearings intersects the axis of the tube being bent.

9. A machine as claimed in claim 7, wherein the roller means mounted in each swivel frame comprises two rollers, the rotary mountings of which in the swivel frame hold the two rollers at right angles to one another and hold the plane of one of the rollers parallel to the rotary axis of the said first and second arms.

10. A machine as claimed in claim 8, wherein the roller means mounted in each swivel frame comprises two rollers, the rotary mountings of which in the swivel frame hold the two rollers at an angle to one another and so that their planes intersect at equal and opposed angles the rotary axis of the said first and second arms.

11. A machine as claimed in claim 1, wherein the roller means held by each of the said first and second arms comprises a plurality of rollers arranged with all their planes intersecting in a common line and providing bearing surfaces arranged together to embrace the engaged tube on three sides.

* * * * *